US005860895A

United States Patent [19]

Lee

[11] Patent Number: 5,860,895

[45] Date of Patent: Jan. 19, 1999

[54] STRUCTURE OF FOLDING COLLAPSIBLE STEP EXERCISING MACHINE

[76] Inventor: Kuo-Lung Lee, No. 61, Mai Jou II Rd., Yi Lan City, Taiwan

[21] Appl. No.: 965,449

[22] Filed: Nov. 6, 1997

[51] Int. Cl.[6] ..... A63B 69/16; A63B 27/04

[52] U.S. Cl. ..... 482/57; 482/51

[58] Field of Search ..... 482/52, 51, 57, 482/70, 71, 72, 53, 60, 61, 62, 111

[56] References Cited

U.S. PATENT DOCUMENTS

| | | | |
|---|---|---|---|
| 5,529,554 | 6/1996 | Eschenbach | 482/57 |
| 5,549,526 | 8/1996 | Rodgers | 482/57 |
| 5,562,574 | 10/1996 | Miller | 482/51 |
| 5,593,371 | 1/1997 | Rodgers | 482/51 |
| 5,601,515 | 2/1997 | Matsumoto | 482/57 |
| 5,651,754 | 7/1997 | Chen | 482/57 |
| 5,692,994 | 12/1997 | Eschenbach | 482/57 |
| 5,746,683 | 5/1998 | Lee | 482/57 |

*Primary Examiner*—Richard J. Apley
*Assistant Examiner*—William LaMarca
*Attorney, Agent, or Firm*—Varndell Legal Group

[57] ABSTRACT

A folding collapsible step exercising machine including a base frame having a transverse front bar and transverse rear bar, a front upright pivoted to the transverse front bar of the base frame and locked in a vertical position by lock means, a driving wheel having a fixed wheel shaft revolvably supported on the base frame, a damping wheel turned with the driving wheel, two pedals, two rear pedal links respectively coupled between rear ends of the pedals and two opposite ends of the fixed wheel shaft of the driving wheel, two front pedal links having a respective bottom end pivoted to a front end of one pedal and a respective top end coupled to the front upright by a slip joint and a respective middle part fixedly mounted with a pivot, and two handlebars respectively turned about the pivots of the front pedal links and having a respective bottom end pivoted to the base frame, wherein two hexagonal end caps are respectively eccentrically coupled to two opposite ends of the transverse front bar of the base frame and turned thereabout, for permitting either of the six peripheral sides of each hexagonal end cap to be disposed in contact with the floor, so as to support the transverse front bar of the base frame in one of six different elevational positions.

3 Claims, 9 Drawing Sheets

STRUCTURE OF FOLDING COLLAPSIBLE STEP EXERCISING MACHINE

BACKGROUND AND SUMMARY OF THE INVENTION

The present invention relates to step exercising machines, and more particularly to an improved structure of folding collapsible step exercising machine that improves the design described in U.S. Pat. No. 5,746,683, entitled "Folding Collapsible Step Exercising Machine".

U.S. Pat. No. 5,746,683, which has invented by the present inventor, discloses a folding collapsible step exercising machine for exercising the legs. This structure of step exercising machine is functional, however the machine base of this structure of step exercising machine can not be adjusted to a tilted position.

The present invention improves the structure of the folding collapsible step exercising machine disclosed in U.S. Pat. No. 5,746,683. According to the present invention, two hexagonal end caps are respectively eccentrically coupled to two opposite ends of the transverse front bar of the base frame. The hexagonal end caps can be turned about the transverse front bar, for permitting either of the six peripheral sides of each hexagonal end cap to be disposed in contact with the floor, so as to support the transverse front bar of the base frame in one of six different elevational position.

DETAILED DESCRIPTION OF THE PREFERRED EMBODIMENT

Figure 1:
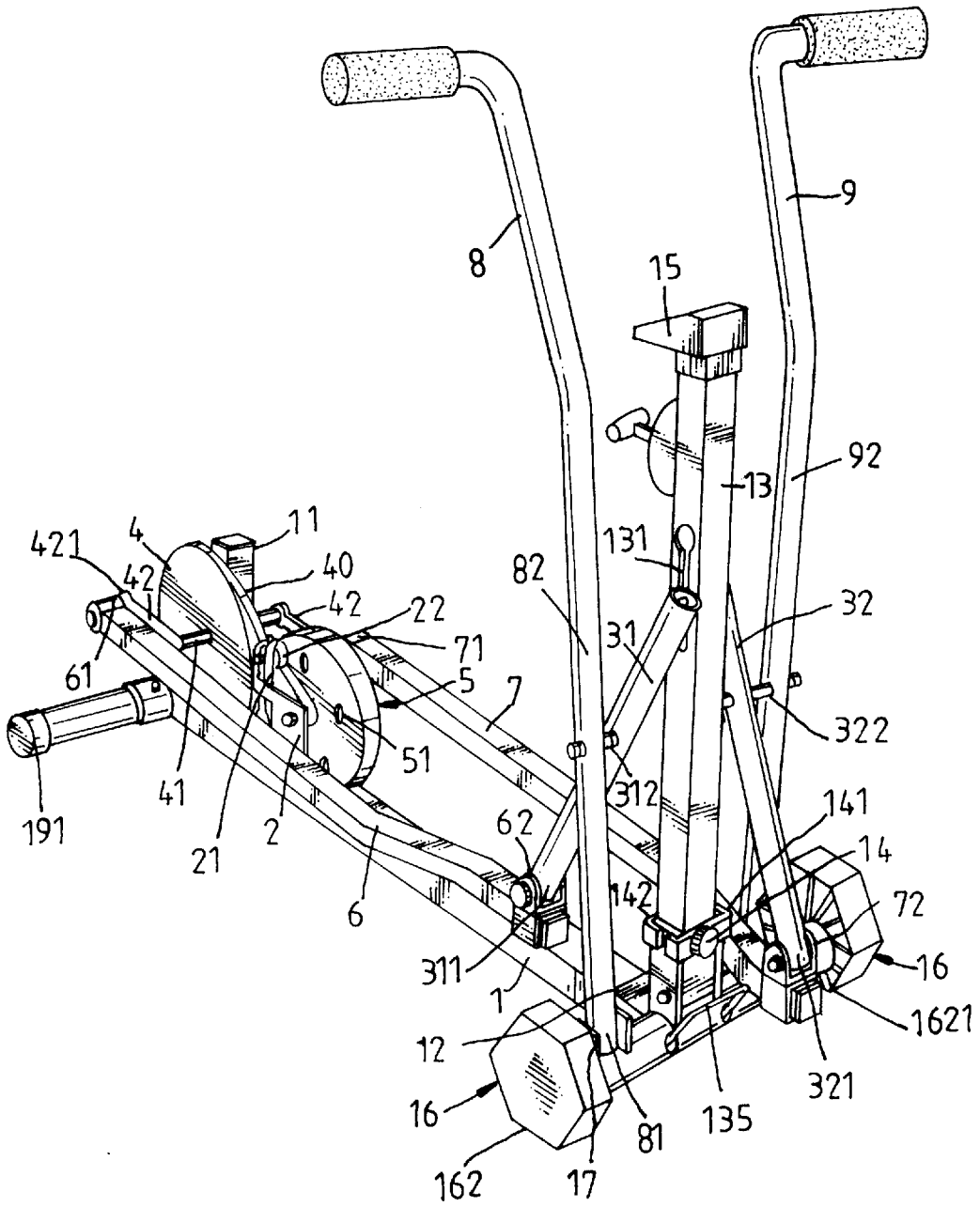
FIG. 1 is a perspective elevational view of an improved structure of folding collapsible step exercising machine according to the present invention (the guard shell and the foot plates excluded).

Referring to FIGS. from 1 to 9, an improved structure of folding collapsible step exercising machine in accordance with the present invention is generally comprised of a substantially I-shaped base frame 1, a front upright 13, a substantially U-shaped damping wheel holder frame 2, a first U-shaped locating plate 141, a second U-shaped locating plate 142, a transmission belt 40, a damping wheel 5, a damping device (not shown) adapted to impart a damping resistance to the damping wheel 5, a driving wheel 4, an idle wheel 22, a first pedal 6, a second pedal 7, two rear pedal links 42, a first front pedal link 31, a second front pedal link 32, a first handelbar 8 and a second handlebar 9.

The I-shaped base frame 1 comprises an upright front mounting frame 12 raised from its front side (transverse front bar) on the middle and adapted for holding the front upright 13, a rear upright support 11 raised from its rear side in the middle and adapted for holding the driving wheel 4, two pairs of upright lugs 17;18 symmetrically raised from its front side and bilaterally spaced from the upright front mounting frame 12 and adapted for holding the handlebar 8;9, two rollers 191 bilaterally mounted on its rear side (transverse rear bar) for supporting the rear part of the I-shaped frame 1 on the floor, and a carrying handle 135 disposed at its front side in front of the upright front mounting frame 12 and adapted for carrying by hand when the step exercising machine is collapsed.

Figure 8:
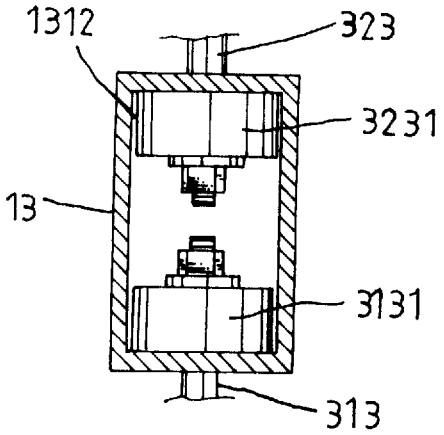
FIG. 8 is a cross sectional view of the front upright according to the present invention, showing the rollers mounted on the wheel axles and moved in the longitudinal sliding tracks.

The front upright 13 has a bottom end 132 pivoted to the upright front mounting frame 12 of the base frame 1, two longitudinal sliding slots 131 bilaterally disposed near its top end, an instrument case 15 fixedly mounted on its top end, and two longitudinal sliding tracks 1312 bilaterally disposed on the inside corresponding to the longitudinal sliding slots 131 (see FIG. 8).

The first U-shaped locating plate 141 and the second U-shaped locating plate 412 are fastened together and secured to the upright front mounting frame 12 of the base frame 1 by a screw 14 to lock the front upright 13 in the operative position. The screw 14 is inserted through a through hole 1411 at the center of the first U-shaped locating plate 141 and threaded into a screw hole 1421 at the center of the second U-shaped locating plate 142 (see FIG. 9) to fix them to the upright front mounting frame 12 of the base frame 1, causing the front upright 13 to be locked in the operative position.

The U-shpaed damping wheel holder frame 2 is fixedly mounted on the base frame 1 between the rear upright support 11 and the upright front mounting frame 12 and adapted for holding the damping wheel 5, having a projecting rod 21 adapted for holding the idle wheel 22 (see FIG. 1).

The idle wheel 22 is pivoted to the projecting rod 21 of the U-shaped damping wheel holder frame 2, and adapted to impart a pressure to the transmission belt 40.

The damping wheel 5 has a fixed wheel shaft 51 revolvably supported on the U-shaped damping wheel holder frame 2 and coupled to the driving wheel 4 through the transmission belt 40.

The driving wheel 4 is revolvably supported on the base frame 1, having a fixed wheel shaft 41 respectively pivoted to rear ends 61; 71 of the pedals 6; 7 by the rear pedal links 42 respectively.

The transmission belt 40 is coupled between the driving wheel 4 and the fixed wheel shaft 51 of the damping wheel 5. The aforesaid idle wheel 22 imparts a pressure to the transmission belt 40, causing the transmission belt 40 to be stretched tight, so that the rotary power of the driving wheel 4 can be efficiently transmitted to the damping wheel 5.

The pedals 6; 7 have a respective rear end 61; 71 respectively pivoted to the rear ends 421 of the pedals links 41, a respective front end fixedly mounted with a respective U-lugs 62; 72 and a respective foot plate 65; 75 respectively disposed at the top side in the middle.

The first front pedal link 31 has a bottom end 311 pivoted to the U-lug 62 of the first pedal 6, a pivot 312 perpendicularly raised from its periphery at one side in the middle and coupled to the first handlebar 8, a wheel axle 313 perpendicularly raised from the periphery of its top end and inserted into one longitudinal sliding slot 131 of the front upright 13, and a roller 3131 revolvably supported on the wheel axle 313 and moved with the first front pedal link 31 in the front upright 13 along one longitudinal sliding track 1312 (see FIG. 8).

The second front pedal link 32 has a bottom end 321 pivoted to the U-lug 72 of the second pedal 7, a pivot 322 perpendicularly raised from its periphery at one side in the middle and coupled to the second handlebar 9, a wheel axle 323 perpendicularly raised from the periphery of its top end and inserted into one longitudinal sliding slot 131 of the front upright 13, and a roller 3231 revolvably supported on the wheel axle 323 and moved with the first front pedal link 31 in the front upright 13 along one longitudinal sliding track 1312 (see FIG. 8).

The handlebars 8; 9 have a respective middle part 82; 92 respectively pivoted to the pivots 312; 322 of the front pedal links 31; 32, and a respective bottom ends 81; 91 respectively pivoted to the U-lugs 17; 18 of the base frame 1.

Further, a guard shell 10 is mounted on the base frame 1 and covered over the driving wheel 4 and the damping wheel 5 for protection.

When in use, the handlebars 8; 9 are grasped with the hands and alternatively pushed and pulled, and the legs are alternatively stepped on the foot plates 65; 75. When pedaling the pedals 6; 7, the driving wheel 4 is rotated to turn damping wheel 5, and the damping device imparts a damping resistance to the damping wheel 5 against the driving power from the user's legs. When the handlebars 8; 9 are pushed and pulled, the rollers 3131; 3231 are moved with the front pedal links 31; 32 up and down along the longitudinal sliding tracks 1312 inside the front upright 13 (see FIG. 8).

Figure 9:
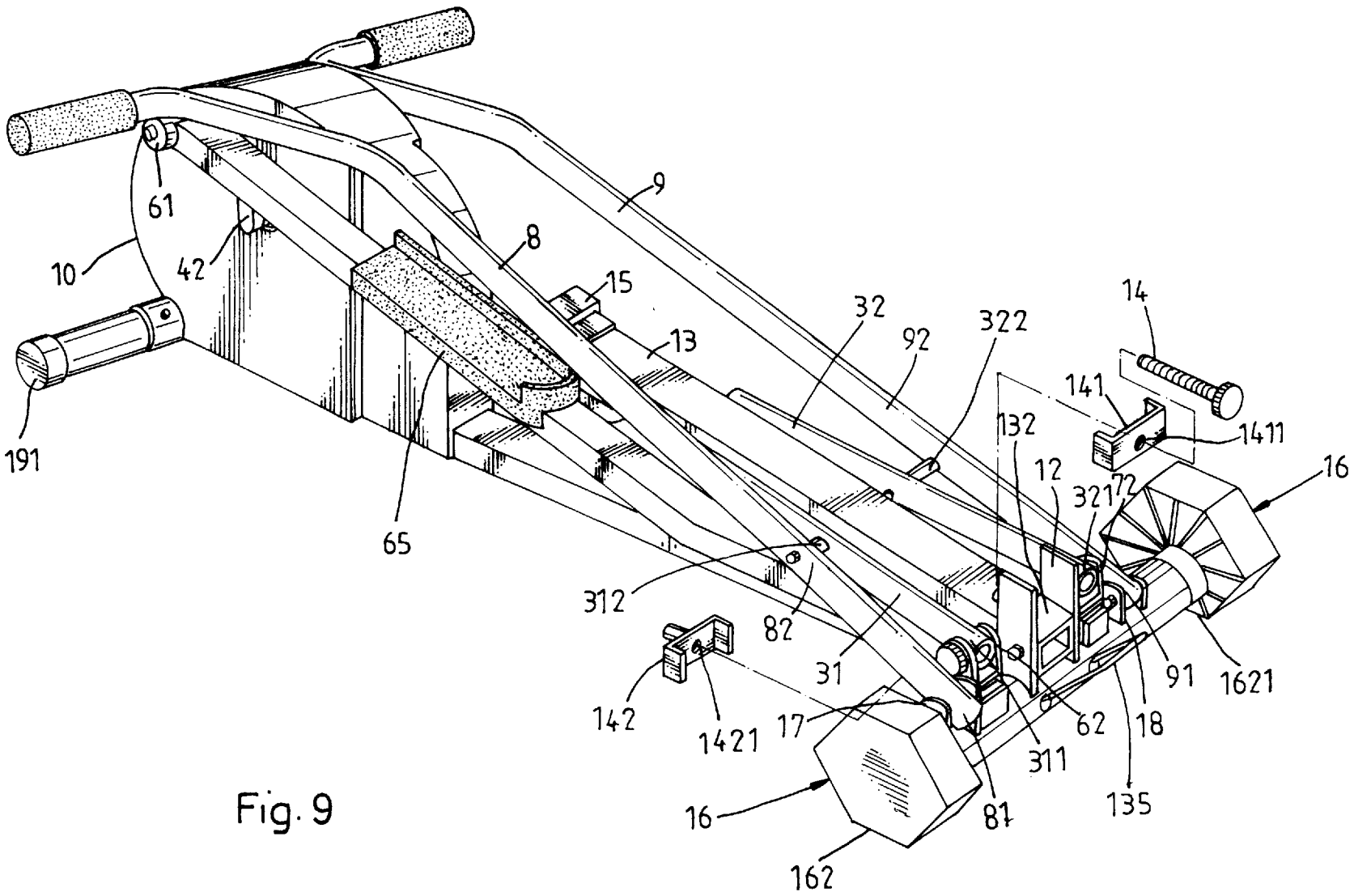
FIG. 9 shows the improved structure of step exercising machine collapsed according to the present invention.

When not in use, the screw 14 is disconnected from the U-shaped locating plates 141; 142 and U-shaped locating plates 141; 142 are moved from the upright front mounting frame 12 of the base frame 1, permitting the front upright 13 and the front pedal links 31; 32 and the handlebars 8; 9 to be folded up and closely attached to the base frame 1 minimize space occupation (see FIG. 9). When collapsed, the user can carry the carrying handle 135 with the hand to lift the front side of the step exercising machine from the ground, permitting the rollers 191 of the base frame 1 to bear the whole gravity weight of the step exercising machine, and therefore the collapsed step exercising machine can be conveniently moved on the ground with less effort.

Figure 2:
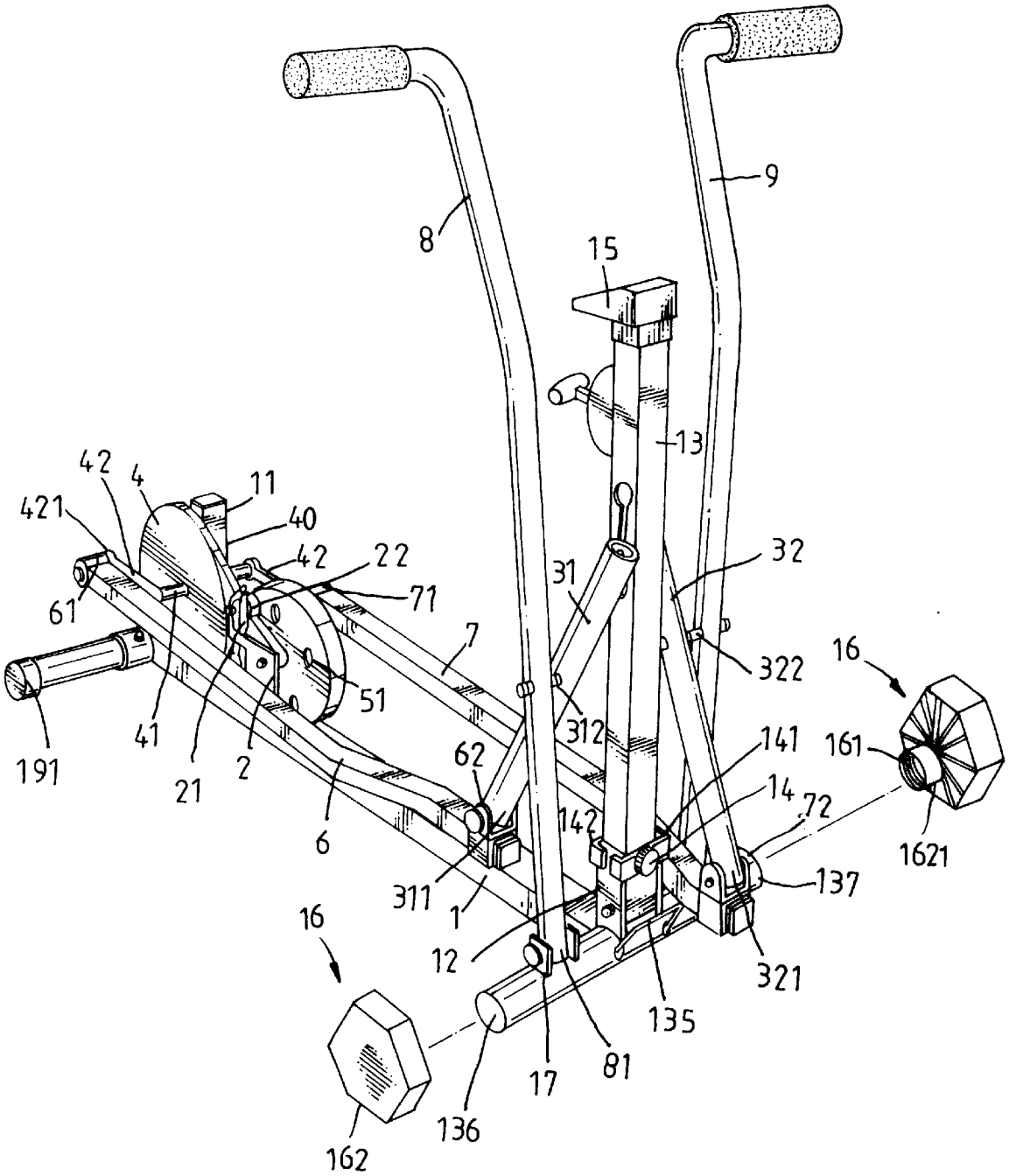
FIG. 2 is an exploded view of the improved structure of folding collapsible step exercising machine shown in FIG. 1.
Figure 3:
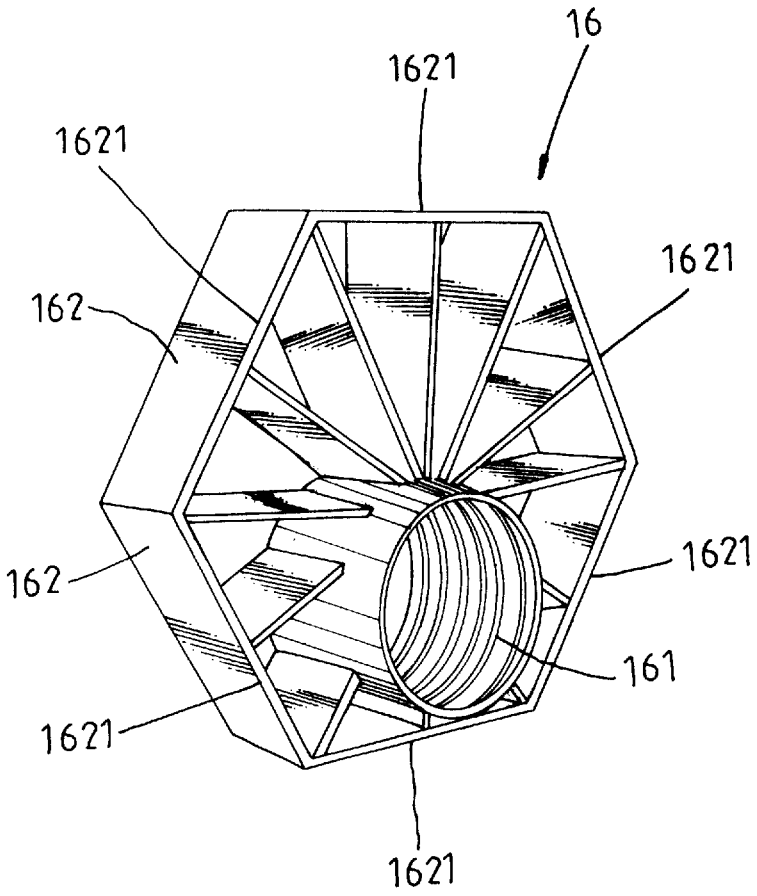
FIG. 3 is a perspective view in an enlarged scale of one end cap according to the present invention.
Figure 4:
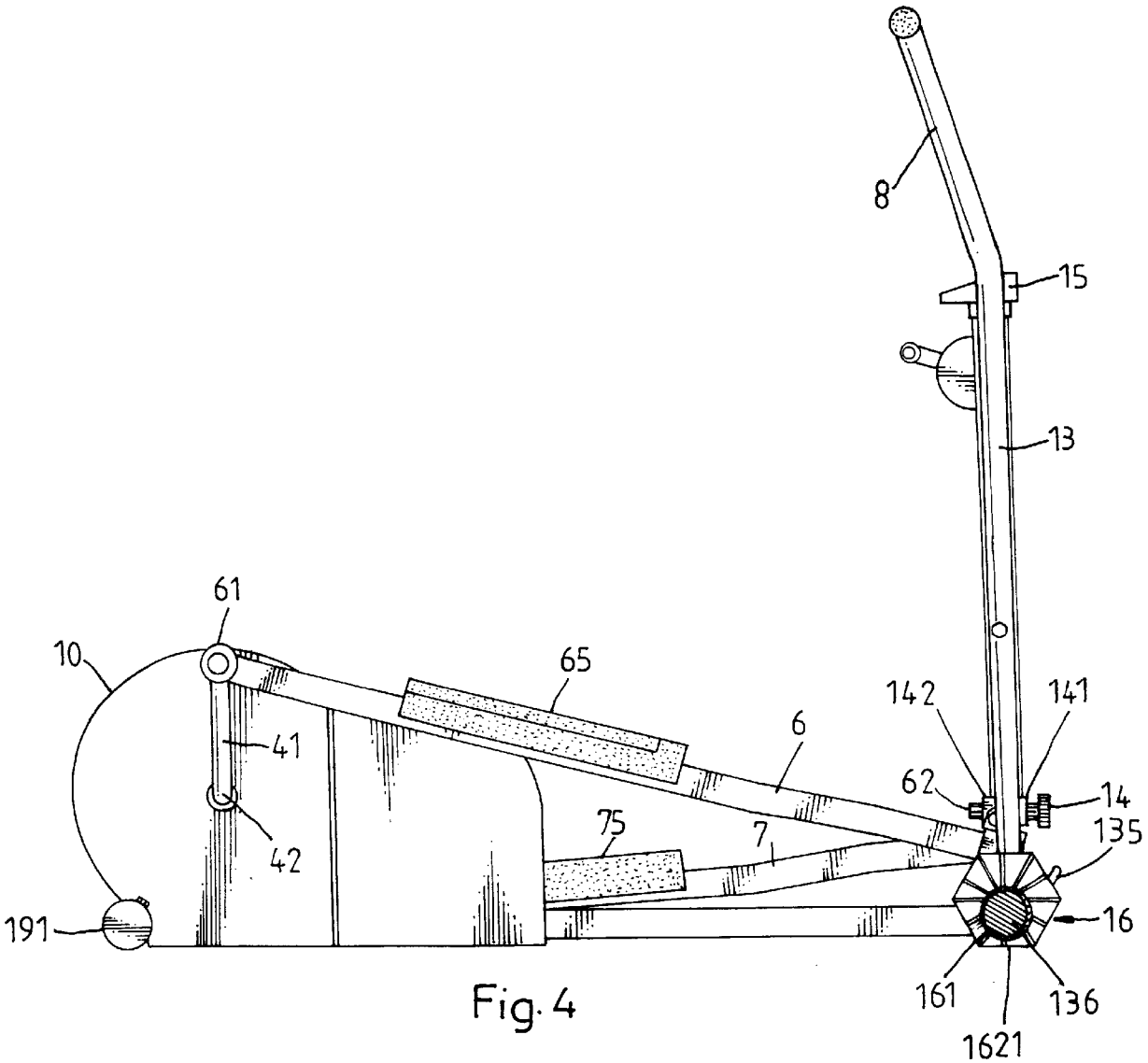
FIG. 4 is a side view partially in section of the improved structure of folding collapsible step exercising machine according to the present invention.
Figure 5:
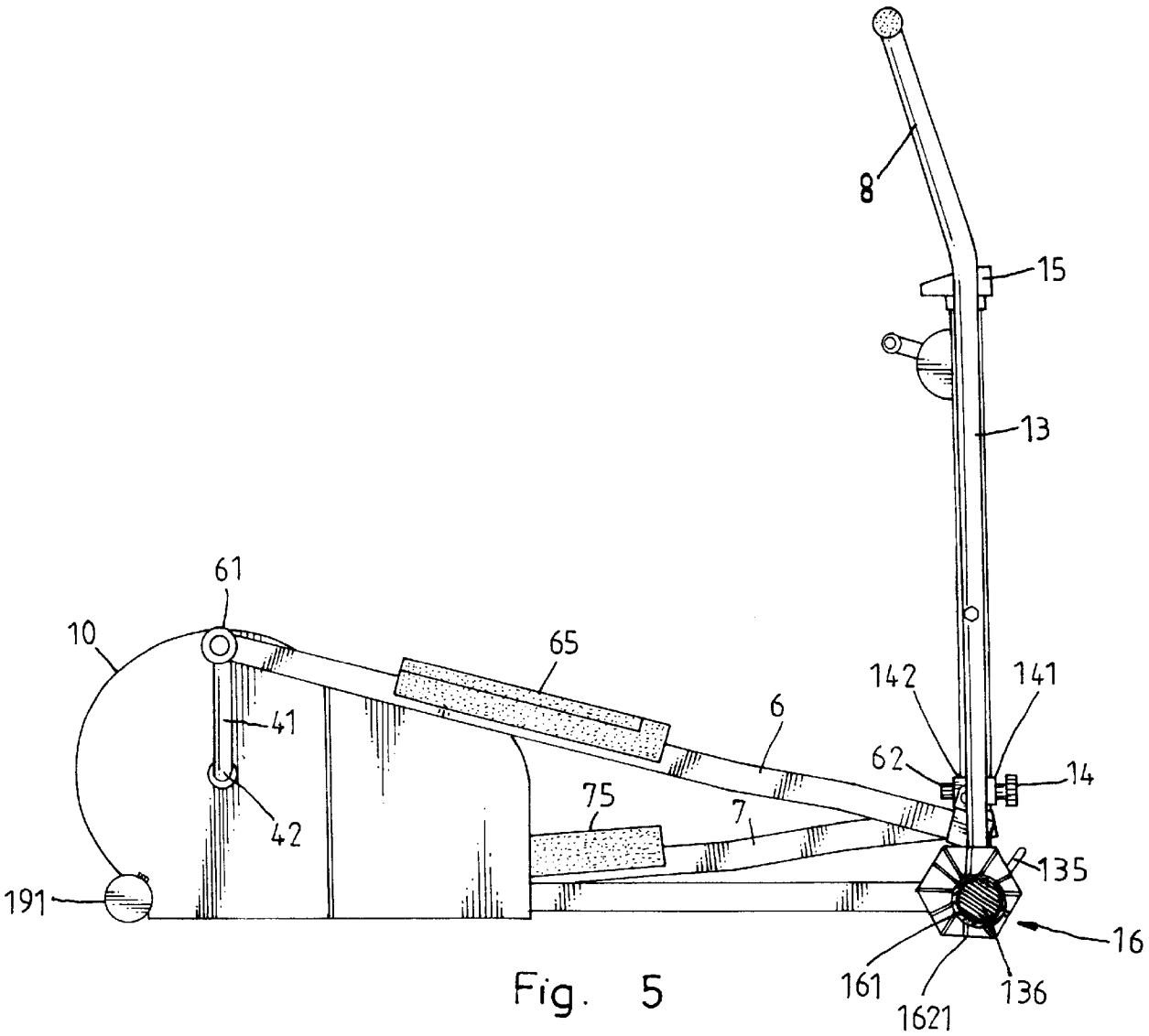
FIG. 5 is similar to FIG. 4 but showing the end caps adjusted to a second angular position.
Figure 6:
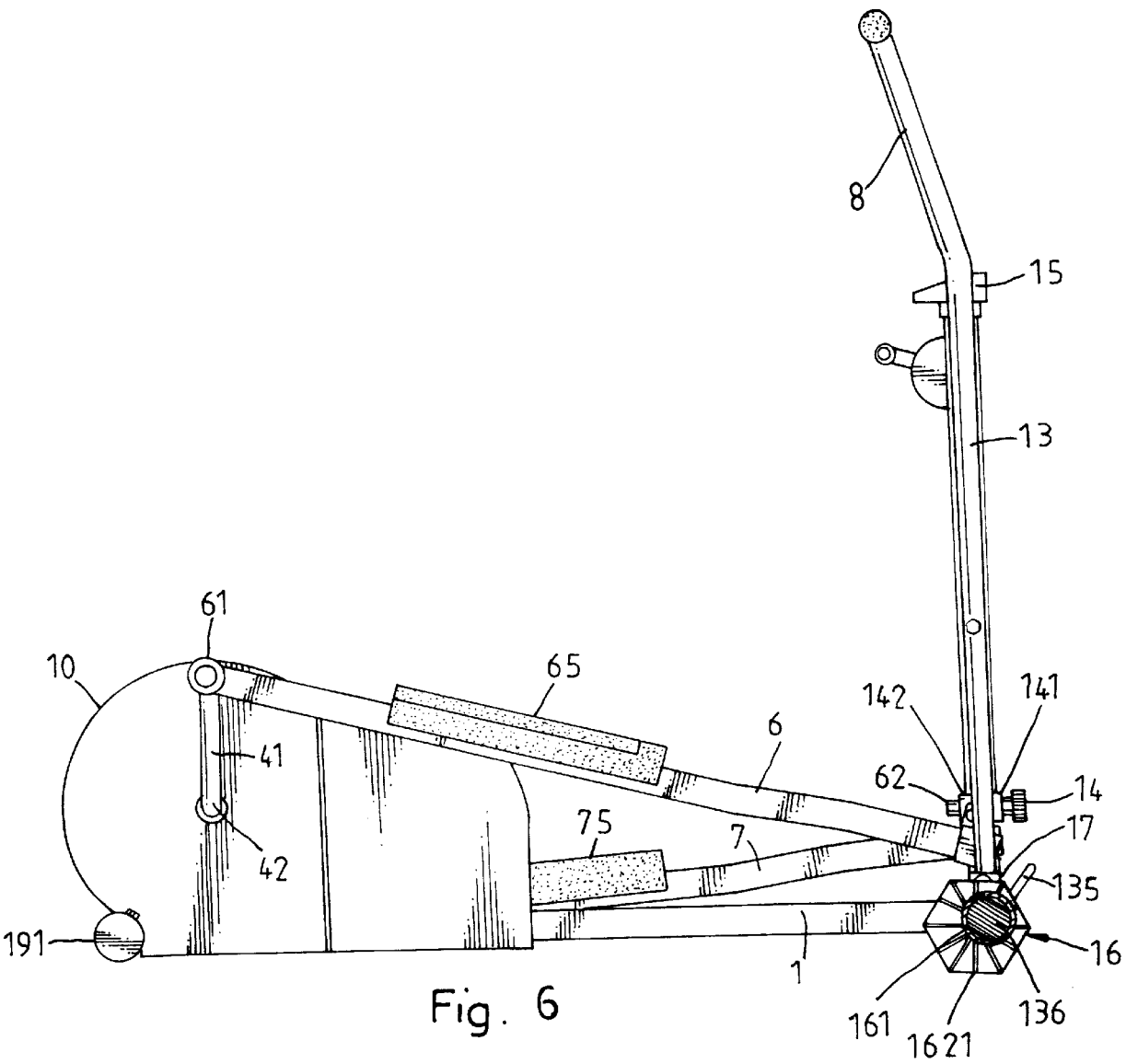
FIG. 6 is similar to FIG. 4 but showing the end caps adjusted to a third angular position.
Figure 7:
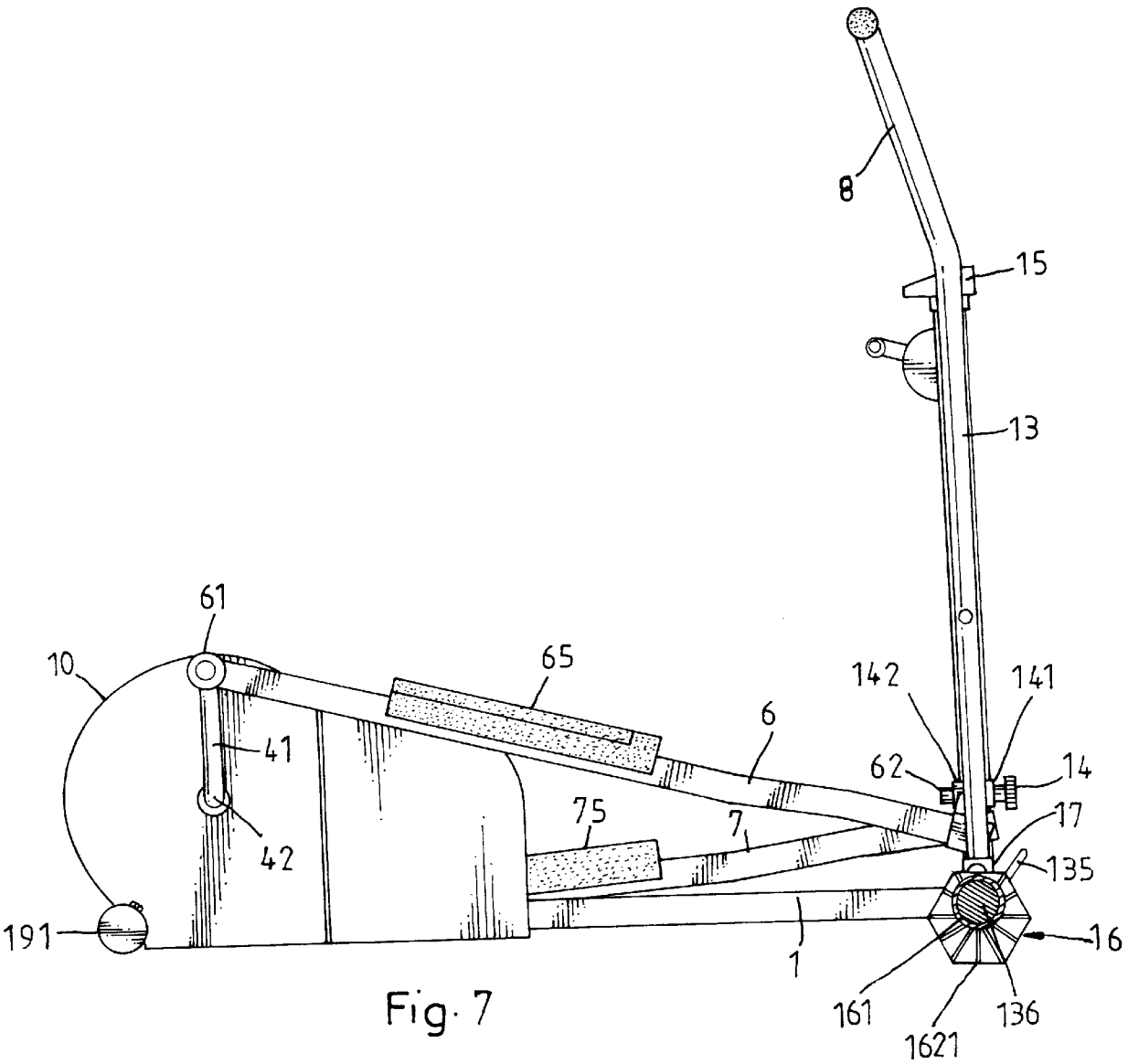
FIG. 7 is similar to FIG. 4 but showing the end caps adjusted to a fourth angular position.

Referring to FIGS. 2, 3 and 4 again, two transverse axles 136; 137 are integral with the front side (transverse front bar) of the I-shaped base frame 1 and arranged in a line. Two hexagonal end caps 16 are respectively coupled to the transverse axles 136; 137 of the I-shaped base frame 1, and adapted for supporting the front part of the base frame 1 on the floor. The angular position of the end caps 16 can be adjusted relative to the transverse axles 136; 137, so that the elevation of the front part of the I-shaped base frame 1 can be relatively adjusted. Each end cap 16 comprises a coupling tube 161 fitting over the transverse axle 136 or 137, six peripheral side walls 162 spaced around the periphral of the coupling tube 161. The outer side edges 1621 of the six peripheral side walls 162 are spaced from the periphery of the coupling tube 161 at different distance, that is, the coupling tube 161 is disposed at an eccentric location relative to the six peripheral side walls 162. The inside wall of the coupling tube 161 is preferably spirally grooved so that the coupling tube 161 can be conveniently mounted on the axle 136 or 137 and turned thereon to let one particular peripheral side wall 162 be disposed in contact with the floor.

Referring to FIGS. from 4 to 7, the end caps 16 can be turned about the axles 136; 137 to the desired angular position, so as to adjust the elevation of the front part of the I-shaped base frame 1 relative to its rear part.

I claim:

1. A folding collapsilbe step exercising machines comprising:

a base frame having an upright front mounting frame raised from a transverse front bar thereof on the middle, a rear upright support raised from a transverse rear bar thereof in the middle, two pairs of upright lugs symmetrically raised from its transverse front bar and bilaterally spaced from said upright front mounting frame, two rollers bilaterally mounted on its transverse rear bar for supporting on the floor, and a carrying handle connected to its transverse front bar in front of said upright front mounting frame for carrying by hand;

a front upright having a bottom end pivoted to said upright front mounting frame of said base frame, a top end, two longitudinal sliding slots bilateraly disposed near its top end, an instrument case fixedly mounted on its top end, and two longitudinal sliding tracks bilaterally disposed on the inside corresponding to said longitudinal sliding slots;

lock means mounted on said upright front mounting frame of said base frame and controlled to lock said front upright in a vertical position;

a U-shaped damping wheel holder frame fixedly mounted on said base frame between said rear upright support and said upright front mounting frame, said U-shaped damping wheel holder frame having a projecting rod;

a damping wheel having a fixed wheel shaft revolvably supported on said U-shaped damping wheel holder frame;

a driving wheel revolvably supported on said rear upright support of said base frame, said driving wheel having a fixed wheel shaft;

two rear pedal links having a respective front end respectively and fixedly connected to two opposite ends of the fixed wheel shaft of said driving wheel, and a respective rear end;

a transmission belt coupled between said driving wheel and the fixed wheel shaft of said damping wheel and driven by said driving wheel to turn said damping wheel;

an idle wheel revolvably supported on said projecting rod of said U-shaped damping wheel holder frame and peripherally disposed in contact with said transmission belt;

two pedals having a respective rear end respectively pivoted to the rear ends of said rear pedal links, a respective front end fixedly mounted with a respective U-lug, and a respective middle part fixedly mounted with a respective foot plate;

two front pedal links respectively coupled between said pedals and said front upright, each of said front pedal links having a bottom end pivoted to the U-lug of one pedal, a pivot perpendicularly raised from the periphery at one side on the middle, a top end, a wheel axle perpendicularly raised from the periphery of its top end and inserted into one longitudinal sliding slot of said front upright, and a roller revolvably supported on said wheel axle and moved with the respective front pedal link along one longitudinal sliding track of said front upright;

two handlebars respectively turned about the pivots of said front pedal links, having a respectively bottom end respectively pivoted to the U-lugs of said base frame; and a guard shell mounted on said base frame and covered over said driving wheel and said transmission belt and said damping wheel;

wherein:

two transverse axles are integral with two opposite ends of the transverse front bar of said base frame and arranged in a line; two hexagonal end caps are respectively coupled to said transverse axles on said transverse front bar of said base frame, and adapted for supporting said transverse front bar of said base frame on the floor, said hexagonal end caps being respectively turned about said transverse axles and set at one of six angular positions for permitting one of six peripheral side walls of each of said hexagonal end caps to be disposed in contact with the floor, each of said hexagonal end caps comprising a coupling tube revolvably supported on one transverse axle of said base frame, six peripheral side walls spaced around the peripheral of said coupling tube at different distances and adapted for contacting the floor.

2. The folding collapsible step exercising machine of claim 1, wherein said coupling tube of each of said hexagonal end caps comprising a spirally grooved inside wall adapted for coupling to the corresponding transverse axle.

3. The folding collapsible step exercising machine of claim 1, wherein said lock means comprises a lock screw, a first U-shaped locating plate having a center through hole, and a second U-shaped locating plate having a center screw hole, said first U-shaped locating plate and said second U-shaped locating plate being fastened together and secured to said upright front mounting frame of said base frame by said lock screw to lock said front upright in the vertical position, said lock screw being inserted through the through hole of said first U-shaped locating plate and threaded into the screw hole of said second U-shaped locating plate to fix said first U-shaped locating plate and said second U-shaped locating plate to said upright front mounting frame of said base frame.

* * * * *